US005517934A

United States Patent [19]

Brown

[11] Patent Number: 5,517,934

[45] Date of Patent: May 21, 1996

[54] PLASTIC BOAT HULL AND METHOD OF BOAT HULL CONSTRUCTION

[76] Inventor: James W. Brown, P.O. Box 550, North, Va. 23128

[21] Appl. No.: 421,908

[22] Filed: Apr. 14, 1995

[51] Int. Cl.[6] ..... B63B 1/00

[52] U.S. Cl. ..... 114/61; 114/357

[58] Field of Search ..... 114/56, 57, 61, 114/123, 271, 274, 283, 292, 357, 39.1, 140

[56] References Cited

U.S. PATENT DOCUMENTS

| | | | |
|---|---|---|---|
| 3,438,074 | 4/1969 | Goyen | 114/357 |
| 3,450,084 | 6/1969 | Gerbracht | 114/61 |
| 3,806,972 | 4/1974 | Jackowski | 114/357 |
| 4,136,414 | 1/1979 | Popkin | 114/61 |
| 4,389,958 | 6/1983 | March | 114/61 |

*Primary Examiner*—Stephen Avila
*Attorney, Agent, or Firm*—Nixon & Vanderhye

[57] ABSTRACT

Disclosed is a plastic boat hull and a method for making a plastic boat hull by roto-molding a thermoplastic material in a mold cavity. The resultant boat hull in a preferred embodiment has an upper hull portion which is identical to the lower hull portion. The forebody, in a preferred embodiment is identical to the afterbody except that one is rotated 90° with respect to the other about the longitudinal axis of the hull. The boat hull shape provides for minimal weight, windage and surface area. The vessel has a wave-piercing bow which creates an asymmetric water plane even though the forebody and afterbody are conceptually identical. The asymmetric water plane reduces pitching of the hull in rough water. In a preferred embodiment, two smaller hulls and one larger hull are combined with cross beams to form a trimaran sailboat.

15 Claims, 3 Drawing Sheets

PLASTIC BOAT HULL AND METHOD OF BOAT HULL CONSTRUCTION

BACKGROUND OF THE INVENTION

1. Field of the Invention

The present invention relates to thermoplastic boat hulls and methods of construction of such thermoplastic boat hulls generally, and to the construction of a trimaran sailboat in particular.

2. Discussion of the Prior Art

Boat hulls have been constructed for centuries out of wood and other natural materials with large quantities of time expended in order to interconnect the pieces of wood in a generally water tight manner. Within the last thirty years, the use of polyester resin and fiberglass reinforcement has lead to the ability to create unusual boat hull configurations and has been widely accepted in the boat building industry.

Unfortunately, the construction of a fiberglass boat hull requires not only a mold to be made, but also a rather labor-intensive hand laying up of layers of fiberglass cloth, roving reinforcement, etc. While the use of more exotic materials such as Kevlar™ and carbon fiber have resulted in extremely lightweight hulls, a significant portion of the cost of any modern fiberglass boat is the labor cost of constructing the hull. The layers of reinforcement materials have to be laid into the mold, the resin added and then sealed or otherwise compressed to obtain the strongest yet lightest resultant structure.

The problem of high labor cost in the construction of boat hulls has been addressed in the kayak hull construction industry in which boat hulls have been made utilizing the "roto-molding" process with the hull material being made of a thermoplastic material, in a preferred embodiment polyethylene. A mold is created whose inner cavity corresponds to the desired outer dimensions of the complete vessel. The desired quantity of thermoplastic polyethylene pellets is added to the mold and the temperature of the mold brought up to above the melting point for the polyethylene. The mold is at the same time rotated about the hull's longitudinal axis and at least rocked back and forth (if not rotated) about the boat's transverse axis. In this way, the entire inner portion of the cavity is coated with the melted polyethylene material.

By varying the local temperature of different portions of the mold, variations in coating thickness can be achieved. When sufficient rotations have occurred to create the desired thickness of melted polyethylene at the various portions of the mold, the mold is cooled (to solidify the polyethylene) and opened to remove the vessel.

For use in small kayaks or similar boat hulls, the polyethylene plastic is a relatively inexpensive structural material. However, it is not rigid and is a relative low modulous material, not nearly as stiff as fiberglass. Consequently, rigidity must be achieved either with the hull shape and/or skin thickness. Unfortunately, thick skins of polyethylene are also heavy relative to some other boat building materials.

The use of rolo-molding eliminates the need for labor intensive hand lay up of the various layers of fiberglass reinforcement in a conventional fiberglass hull. Consequently, due to the inexpensive nature of the polyethylene plastic and the fact that the rolo-molding is a more-or-less automatic operation, the cost for making a kayak-type boat hull is relatively inexpensive. However, conventional kayak designs are not sufficiently strong and stable to withstand the stress of serious sailing, and normally there is no provision for being able to power such a craft by sail.

Consequently, there is a need for a boat hull shape which can be easily coated in the mold cavity by rolo-molding, which has the necessary distribution of polyethylene (in terms of skin thickness) so as to be sufficiently rigid to withstand the stress of sailing while at the same time not being overly thick so as to be overly heavy and which can be easily propelled through the water either by human power, sail power or small motor power.

It would be desirable to provide a boat hull which is roto-moldable and can be used in conjunction with a sail for propulsion. Again, to withstand the stresses of the sail, some attention to the ability to rolo-mold an even thickness with appropriate increases in thickness in areas related to the support of the mast and cross beams would be necessary. Furthermore, one problem with existing sail powered craft, especially relatively small ones, is that when sailing in a chop, a fair amount of tore and aft rocking or "hobby horsing" motion exists. Quite obviously, this can be uncomfortable to the sailor but of more importance is the fact that this causes the mast and the sail to be pitched tore and aft changing the relative wind on the sail in terms of velocity and angle. The result of this movement is that the sail acts much more inefficiently than it would without the hobby horsing motion.

SUMMARY OF THE INVENTION

In accordance with the above prior art problems, Applicant's vessel is a geometric shape which eases the roto-molding process in terms of the distribution of melted polyethylene material, has minimal surface area and therefore results in a light weight and yet sufficiently structurally strong vessel which can be easily driven along the water.

Applicant's boat hull comprises upper and lower hull portions which are in fact integrally molded in a single rolo-molding mold using conventional rolo-molding techniques. However, the upper hull portion is substantially a mirror image of the lower hull portion (if any external appurtenances such as cockpit combing, keel, etc. are not considered). Furthermore, and perhaps more significantly, in a preferred embodiment, the hull shape for the upper portion and lower portions are comprised of the surface of a torus which serves to impart a certain "eggshell" rigidity on the plastic hull. The forebody of the hull begins with a narrow (in the horizontal direction) bow which is useful for cutting into and through the waves. However, the afterbody of the hull has a flattened curved portion which is narrow (in the vertical direction) and allows the water to rejoin under the rear portion of the hull with the lowest possible hydrodynamic drag. The vessel's profile is unusually low at both ends so as to reduce windage.

In a preferred embodiment, the afterbody is similar to the forebody except that it has been rotated 90° about the longitudinal axis of the boat hull. This rotation permits a fine entry boat hull with a broad rear departure of the water from the hull. This results in a water plane which is asymmetric about a transverse section. The effect of this asymmetric water plane is to severely reduce any pitching or "hobby horsing" tendency of the craft.

In preferred embodiments of the present invention, the boat hull is utilized to create a multi-hull craft and, in a further preferred embodiment, a trimaran sailboat.

BRIEF DESCRIPTION OF THE DRAWINGS

The present invention will now be described in more detail, by way of example, with reference to the accompanying drawings in which.

DETAILED DESCRIPTION OF PREFERRED EMBODIMENTS

Figure 1:
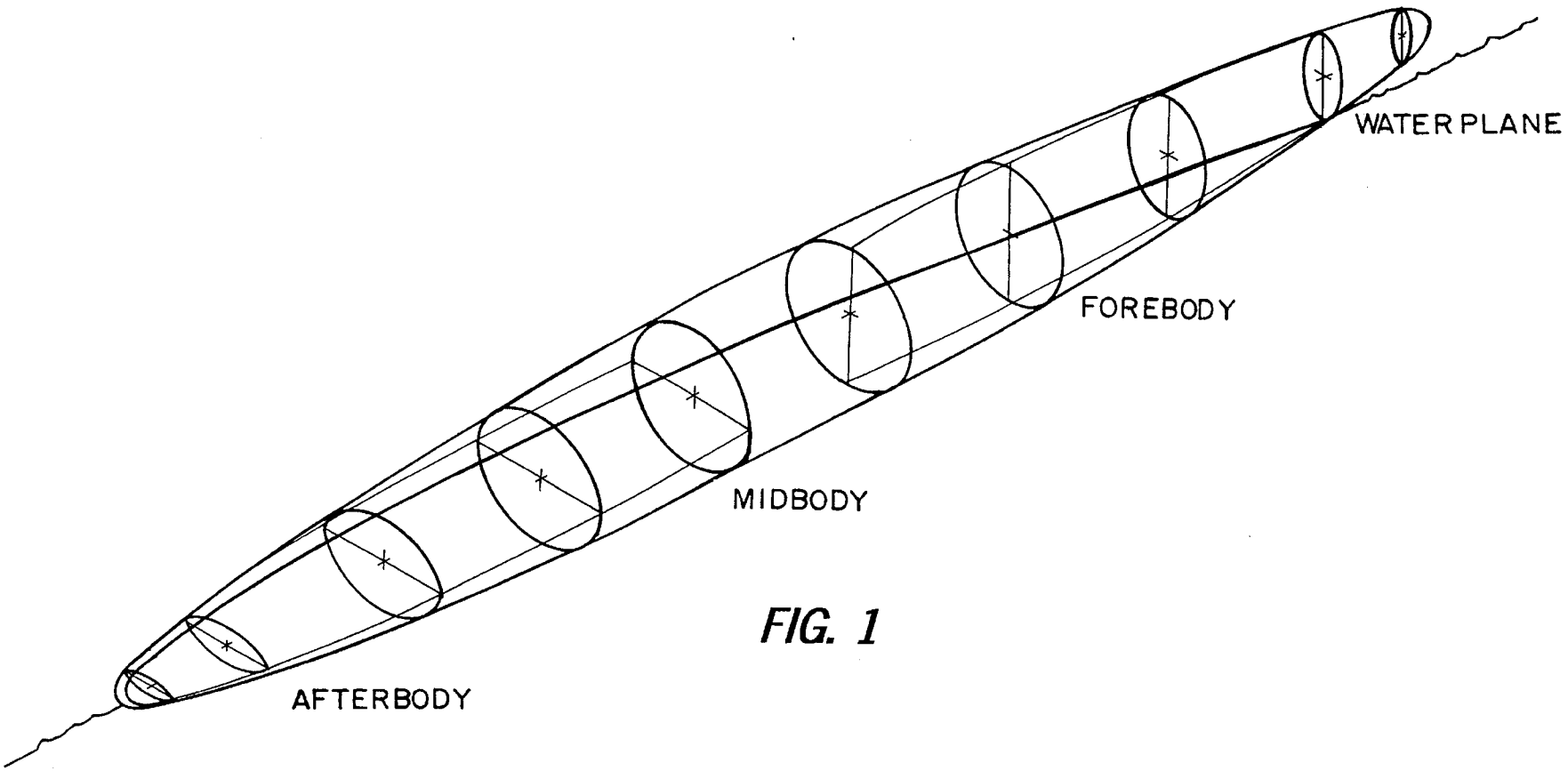
FIG. 1 is a perspective view of a boat hull in accordance with the present invention without including any appurtenances.

Similar elements of the present invention are identified with the same reference numerals in the separate drawings.

1. The Basic Hull Shape

FIG. 1 illustrates the configuration of the vessel in accordance with the present invention. In this preferred embodiment, the midbody is of a circular cross-section. However, the forebody, that portion of the hull forward of the midbody section, is of a narrowing construction such that the nose or bow of the boat is extremely thin and can serve to part the water without providing a great deal of buoyancy at that end. In the side view of the forebody portion of the boat hull shown in FIG. 2, the "lens-like" shape comprised of intersecting circular arcs of the preferred embodiment can be seen.

Accordingly, as the forebody of the boat hull moves through the water and is struck by a wave, the lack of buoyancy in the bow will tend to pitch the bow up or down very little if at all. The result is that the wave striking the bow is split on to either side of the bow and, in the case of a large wave, may actually bury the bow. As the large wave passes over the bow, and recedes, it is parted along the forebody so that it disperses on either side of the center line plane as shown. This fine entry, known as a "wave piercing" bow or forebody, is a known technique in boat hulls as evidenced by the catamaran vessel shown in U.S. Pat. No. 5,191,848 issued to Hatfield on Mar. 9, 1993, the subject matter of which is incorporated by reference.

While the forebody tends to split the water apart, in order to maintain low drag on the hull, it is necessary to allow the water to naturally flow back together as the vessel passes. This is accomplished by an afterbody as shown in FIG. 1 in which the sections are oriented about a horizontal center line plane which results in a relatively flat "duck tail" stern of the craft. The observer will note that in the forebody, the orientation of the sections have a longitudinal axis in the vertical plane whereas in the after body, the sections have a longitudinal axis in the horizontal plane. In effect, the after body is rotated 90° with respect to the forebody.

Where, as here, the sections of the vessel are generally comprised of portions of circles, it is extremely easy through roto-molding to obtain a desired relatively even distribution of plastic material on the inside of the mold cavity in order to create such a hull. The wave piercing aspect of the forebody as compared to the low drag aspect of the after body can also be seen in the side view of the craft shown in FIG. 2.

Figure 2:
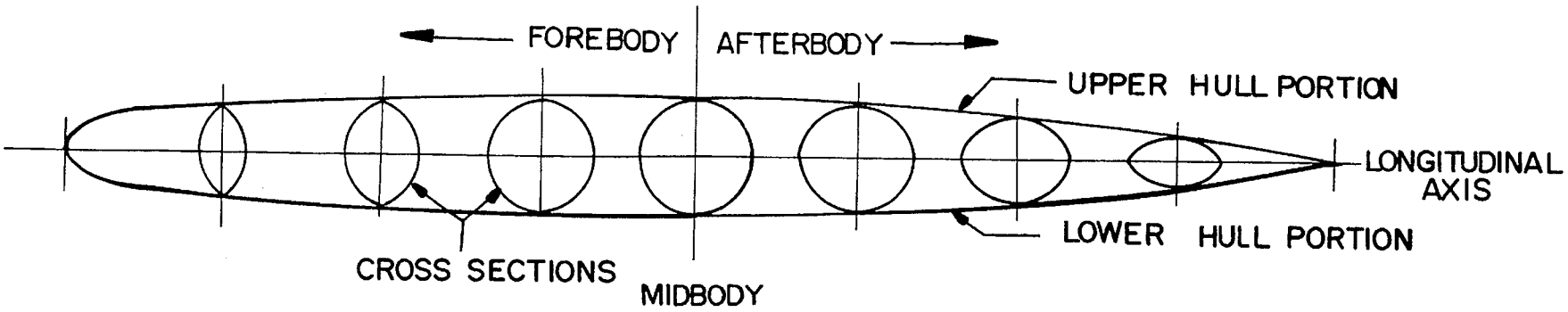
FIG. 2 is a side view of the boat hull shown in FIG. 1.

FIG. 2 is a side view of the boat hull shown in FIG. 1 where the bow and the forebody are to the left and the stern and the afterbody are to the right. However, because the forebody and afterbody are, in this preferred embodiment, identical shapes with the exception that the afterbody has been rotated 90° with respect to the forebody, FIG. 2 is also a plan view of the boat hull shown in FIG. 1 with the bow at the right-hand side of the drawing with the stern at the left. This unique quarter twist geometry of Applicant's boat hull provides not only a low drag, wave piercing entry of the hull into waves (and the reduced hobby horsing effect resultant therefrom), but also a low drag stern section allowing the boat hull to be moved through the water with ease. This unique boat hull can also readily be mass produced through the use of roto-molding and is readily adapted to the rolo-molding method of plastic boat construction.

Figure 3:
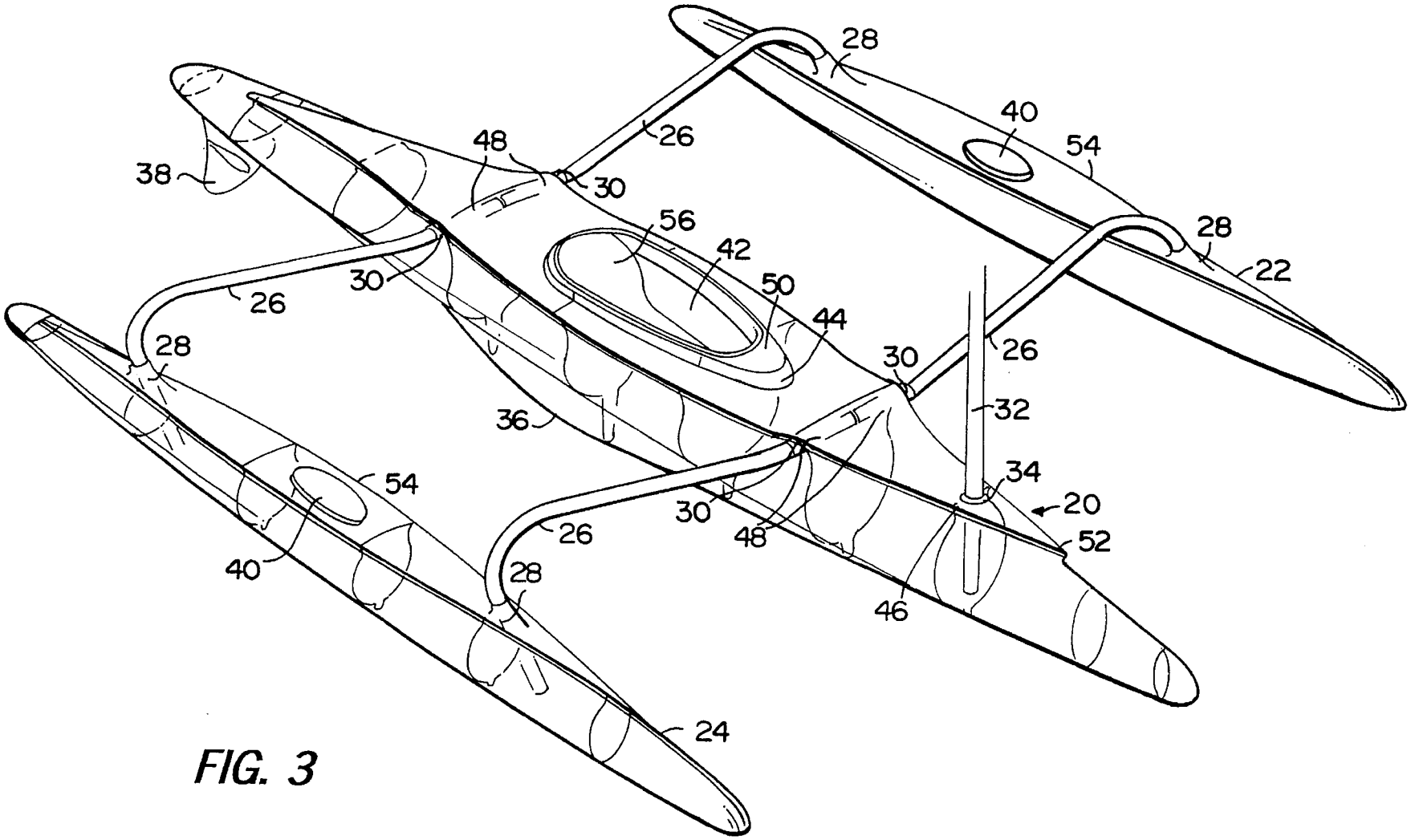
FIG. 3 is a perspective view illustrating the boat hull in accordance with the present invention with appurtenances and connected to two smaller boat hulls in a trimaran sailboat configuration.

FIG. 3 discloses a preferred embodiment of the disclosed boat hull in which a larger center hull 20 and port and starboard smaller hulls, 22 and 24, respectively. In this preferred embodiment, four identical cross beams 26 interconnect the smaller hulls 22 & 24 with the center hull 20. The cross beam connection with each of the hulls is through a pair of cross beam sockets 28 located on each of the smaller hulls into which the ends of cross beams 26 are located, with the other ends of the cross beams 26 fitted into center hull cross beam sockets 30.

In a preferred embodiment, the cross beams are comprised of an aluminum tube curved with a radius of curvature not less than about four tube diameters (so as to prevent structural weakening of the tube). The cross beam sockets themselves, in a preferred embodiment, comprise a slightly larger diameter aluminum tube which can be molded into both the smaller and larger hulls during rolo-molding or added afterwards, whichever is more convenient. In a preferred embodiment, the cross beam sockets in the larger hull extend all the way through from one side to the other and accommodate the ends of opposing cross beams at both the front and rear of the hull.

In a preferred embodiment, the cross beams are maintained in their position within the cross beam sockets by means of a push pin which extends through both the cross beam socket and the cross beam portion itself. Such pins are conventionally known and take the form of a device which, when a button on the end is pushed, a ball near the opposite end is retracted into the push pin allowing it to be inserted into and through a series of holes in the cross beam socket and the cross beams. After insertion, the button is released which forces the ball to expand and extend outward somewhat from the push pin preventing the pins removal from its aperture in the cross beam and cross beam socket. In this way, the push pin is firmly retained within the socket/cross beam junction and prevents separation thereof.

In a preferred embodiment of the trimaran, a mast 32 is a similar aluminum tube which is stepped in mast socket 34. The mast can be retained in the mast socket by the use of a similar push pin arrangement as in the cross beam sockets. It will be noticed that each of the three hulls in the trimaran are not identical to the hull shape shown in FIGS. 1 and 2 but rather include appurtenances such as a keel 36, a rudder 38, a hatch 40, a cockpit 42, a combing 44 (surrounding the cockpit), a mast partner 46 (a localized thickening of the structure to help support the mast socket), a beam faring 48, a spray deflector 50, a stiffening ridge 52 and/or a styling line 54.

One benefit of roto-molding is that portions of plastic material tend to build up thickness in areas where a sharp angle is located and consequently, the stiffening ridge 52 and styling line 54 provide an increase in structural integrity not only because of their geometric shape, but also because they will be slightly thicker than the general hull thickness. The same is true with the combing, the beam fairing and the spray deflector. While in a preferred embodiment, a single seat 56 can be located in the cockpit, a tandem two seater would also be advantageous. The seat should be adjustable from an upright position for manual paddling to a more recumbent position when sailing (to be behind the spray deflector). Additionally, the spray deflector 50 could be a folding structure or even a full enclosure to permit sailing in inclement weather.

Rudder 38 is movably mounted so as to provide the ability to steer the craft and manipulation of the rudder could be through an external tiller or internal rudder pedals in much the same manner as aircraft rudder pedals are operated.

The cross beams are shown having their sockets "raked" or leaning towards the rear of the craft. This permits a relatively large radius bend in the cross beams themselves without having those beams unduly extending upward into the air, possibly obscuring the skipper's vision and creating wind drag. An alternative cross beam attachment could be the embedding of threaded inserts in the material of the smaller hulls or floats, and then having a plate welded to the end of the cross beam which is bolted down to the embedded inserts, thereby securing the connection.

An additional method of connecting the cross beams to the floats would feature a plate welded to the socket which, when the socket is installed, fits flush with the deck and can be fastened to threaded inserts molded into the deck. The lower end of the socket may be bonded into the bilge of the float. In a further alternative, all cross beam sockets are cast or molded in during the roto-molding process. An additional embodiment for mounting the cross beams to the main hull would be to lay them in transverse channels in the deck of the main hull and fasten them to the deck with u-bolts fastened to backing blocks underneath the deck. In this embodiment, the cross beams would advantageously be continuous from one float to the other.

In a preferred embodiment, the vertical axes and horizontal axes of all three hulls, respectively, are parallel. However, it may be preferable in some circumstances to have the smaller hulls slightly "toe'd out," i.e., a greater distance between the bows of the smaller hulls than the distance between the sterns of the smaller hulls. This may provide some reduction in drag.

While a single mast 32 has been shown, multiple masts could be used. Additionally, even though an unstayed mast has been shown, a stayed mast could be advantageously utilized in combination with a two or three hulled craft. Where an unstayed mast is used, it is anticipated that the mast would be stepped through the deck onto the bilge with suitable internal structure to carry mast bending loads through to the front cross beams. Either a stayed or unstayed mast could be stepped on the front cross beam or a suitable structure (a "mast partner") for passing the bending loads through to the cross beams. Preferably in these embodiments, the cross beam would be a single piece element which would have the effect of not needing the structural strength of the vessel to carry heeling loads onto the cross beams. Conventional aluminum mast construction could be used although carbon fiber masts of the sort used by windsurfer-type sailboats may be advantageous.

The benefits which accrue from the hull shape disclosed in FIGS. 1 and 2 and applied to the trimaran sailboat in FIG. 3 are numerous and significant. Firstly, the use in the preferred embodiment of a circular section midbody provides the greatest displacement for the minimum wetted surface area possible. Where surface effect drag is concerned, the long, slender wave-piercing forebody is extremely efficient at opening the way for the remainder of the hull through the water and waves.

In a preferred embodiment, the central vessel has a fineness ratio of about 10:1 which is three times as fine as an equivalent mono-hull sailboat and is even finer than most kayaks. It is also noted that the hull shape shown and described has very high prismatic and block coefficients. As a result, this hull form has a minimal wetted surface area for the maximum displacement given that the sea-kindliness of a wave-piercing forebody was desired.

Because, in the preferred embodiment, the upper and lower portions of the afterbody and the right and left portions of the forebody are portions of the surface of a torus, they are curved in both directions achieving "eggshell rigidity." There are no flat sections or recurves (curving in the other direction) which would otherwise weaken the hull. Thus, even through polyethylene plastic is not nearly as stiff as fiberglass, the use of polyethylene and the "eggshell rigidity" provide a hull form which achieves a very high degree of rigidity (for a roto-molded plastic hull) and yet is reasonably low drag because of the hull shape. Because of its minimal surface area, it is reasonably lightweight even though thick skins of polyethylene plastic are normally relatively heavy.

As noted, the water plane of this hull is asymmetric about the transverse midbody axis. The water plane is the shape that the water line would describe when viewed from the top. It can be seen in FIG. 1 that the forebody would have a relatively sharp narrow shape defined by its water line whereas the afterbody will have a much wider, more rounded shape. Assuming the craft displaces approximately one third the available displacement (has a water line somewhat below the longitudinal axis illustrated in FIG. 2), there would be an extremely narrow water plane extending to the front of the vessel but the water plane at the stern would be relatively wide. As a consequence, when the vessel is immersed more deeply, there is a very increase in buoyancy available from the forebody while there would be a great increase in buoyancy at the stern.

Upon encountering a wave, the forebody would generate relatively little upward pitching movement and indeed it is envisioned that waves would pass or break on the top of the forebody as it cuts through the wave. Any slight pitching moment created by the encountering of the wave would be offset by a much greater degree of buoyancy available at the stern with the result that the stern is not easily depressed and "hobby horsing" is greatly reduced. This difference in buoyancy is a result of the asymmetrical water plane which in turn is a consequence of the shape of the upper and lower hulls and the forebody and afterbody.

Further, it will be noted that as a result of its configuration there is very little "windage" on the vessel's bow and stern. This is also intentional in that many times it is desirable to be able to paddle a small kayak or sailboat and the low windage prevents the wind from acting on the hulls in the event the occupant is paddling to windward. This reduced windage is another result of the hull configuration and permits the efficient application of the 1/16 horsepower that can be developed by most humans.

Some discussion has already been made of the low elliptical profile wave piercing bow which also serves to reduce hobby horsing. Instead of climbing over an oncoming wave as many conventional boat hulls do, the forebody pierces through the wave and allows the wave to break over the top of the forebody. By reducing hobby horsing with the asymmetrical water plane and the wave piercing bow, the sail becomes much more stable in the wind which allows the air to develop laminar flow over a greater portion of the sail, thus producing greater drive and more efficiency.

One aspect in the preferred embodiment of the present application is that the deck or upper hull portion of the forebody must have more or less the same shape as the lower hull portion of the forebody. This over/under similarity is desirable to permit the whole forward end of the craft to slice through the surface of the water from above and below with equal facility. Once the bow is driven into a wave, it must be able to climb back out without being held down by solid water on top of a flat deck. The narrowed sections in the upper forebody permit the water to split down and pass back over the deck as the bow climbs back to the surface on the backside of a wave.

It will be appreciated that the use of a wave piercing bow can send a fair amount of water across the deck and Applicant's preferred embodiments provide appurtenances such as the stiffening ridge 52, the cockpit combing 44 and the spray deflector 50 for splitting the water and peeling it back around the cockpit. The sailor could alternatively utilize a kayaker's spray skirt to seal the cockpit, thereby preventing the entry of any water into the cockpit. However, a substantial sprayshield or windshield may be the most reasonable approach to reducing water in the cockpit.

In the present embodiment, an oval midsection rather than a circle could be utilized but some transition between the shape of the forebody and the afterbody would be necessary. In a preferred embodiment, the skin of the forebody and afterbody are sections taken from a torus but with the afterbody rotated 90°. However, sections other than the surface of a torus could certainly be utilized in the present invention to good effect. Additionally, while in a preferred embodiment the afterbody is identical to the forebody except one is rotated by 90° with respect to the other, it is only necessary that they be reasonably similar so that they can be similarly coated during the roto-molding process and benefit from the other advantages of low windage, wave piercing and asymmetric water plane.

Additionally, it can be seen in the side view of FIG. 2 that the preferred embodiment of the upper hull portion is identical to the lower hull portion. However, some minor differences between the upper and lower hull portions could be accommodated in the mold as long as there were reasonable similarities in the coating of the upper and lower mold portions during the rolo-molding processes.

A further benefit of the cross beam arrangement in the trimaran is the fact that with the vertical entry of the cross beam into the smaller hull sockets. the cross beam extends above the water somewhat so that even if an outer hull is completely buried by a wave (in the preferred embodiment, the outer hulls have the same wave piercing capability as the main hull), the wave would not strike the beam thereby minimizing hydrodynamic drag on the beams themselves.

An additional benefit is that, in production, the bends of each of the cross beams is identical allowing a manufacturer to store only one cross beam configuration which could be used to replace any one of the tour that might be damaged. Also, with respect to the cross beam sockets, the "raked" angle not only reduces the overall height of the beam above the water line, thereby reducing windage while still providing space to indicate the more than 90° bend in the tubing, it further reduces water drag when the smaller hull is fully immersed (the raked back beam generates less drag than a vertical beam).

In a preferred embodiment the cross beam is of a marine grade aluminum alloy with an outside diameter of 2.5 inches and a thickness sufficient to withstand a bending load of 1,400 ft. lbs. The radii of curvature for the bends in the cross beams is 12 inches. The sockets in the larger hull and the smaller hulls are of the next size larger tubing with a polyethylene insert to take up any space between the outside diameter of the cross beam tube and the inside diameter of the socket. In the preferred embodiment the smaller hull sockets are raked back 45°. The cross beam in a preferred embodiment extends into the smaller hull sockets 11 inches and into the large hull sockets 12 inches.

The raked cross beam also permits the stresses of the cross beam to be carried all the way through to the bottom of the smaller hulls which tends to reduce flexing in the relatively flexible polyethylene hulls. Finally, and perhaps most importantly, the raked angle more or less parallels the load path being delivered from the out rigger hull to the cross beam when under sail. This load path is the combination of an upward force tending to resist the heeling effect of the wind on the sail and the backward three generated by the drag of the smaller hull as it moves through the water. It is important to parallel this load path if possible in a polyethylene hull for it reduces the prying stresses exerted on the hull at the point of the cross beam/cross beam socket connection. The various inserts, sockets and other materials which are not made of polyethylene can be molded into the hull during the conventional roto-molding process.

While the invention has been described in connection with what is presently considered to be the most practical and preferred embodiment, it is to be understood that the invention is not to be limited to the disclosed embodiment, but on the contrary, is intended to cover various modifications and developments included within the spirit and scope of the appended claims.

What is claimed is:

1. A boat hull having a forebody and an afterbody, said forebody and said afterbody meeting at approximately a midpoint of the boat hull, said boat hull comprising:

a lower hull portion; and an upper hull portion joined to said lower hull portion, said upper hull portion, excluding any appurtenances, is substantially a mirror image of said lower hull portion and said forebody and said afterbody, both without appurtenances, are similar but with one of said forebody and afterbody at least partially rotated about a longitudinal axis of the boat hull with respect to the other of the forebody and afterbody, said lower hull portion including a water plane which is asymmetric about a midpoint section transverse to the boat hull.

2. A boat hull in accordance with claim 1, wherein a transverse section of said boat hull at said midpoint is a circle.

3. A boat hull in accordance with claim 1, wherein said forebody is narrow and vertically oriented and said afterbody is narrow and horizontally oriented.

4. A boat hull in accordance with claim 1, wherein said boat hull is comprised of a thermoplastic material.

5. A boat hull in accordance with claim 4, wherein said thermoplastic material is polyethylene.

6. A boat hull in accordance with claim 1, wherein transverse sections of said forebody comprise lens-like portions with a vertical axis and transverse sections of said afterbody comprise lens-like portions with a horizontal axis.

7. A boat hull in accordance with claim 1, wherein said boat hull includes appurtenances including at least one of a keel, a transom, a cockpit, a hatch, a coaming, a mast partner, a beam fairing, a spray deflector, a stiffening ridge, and a styling line.

8. A boat hull in accordance with claim 1, wherein said boat hull lower hull portion and upper hull portion are comprised of a single roto-molded plastic part.

9. A boat hull in accordance with claim 1, wherein said boat hull afterbody is rotated 90° along the longitudinal axis with respect to said forebody.

10. A boat hull in accordance with claim 1, wherein said forebody of said upper hull portion and said lower hull portion is comprised of two geometrical shapes, each of said shapes are identical to the surface of at least a portion of a torus.

11. A multihull sailboat comprising:

at least two similar boat hulls, each boat hull having a forebody and an afterbody, said forebody and said afterbody meeting at approximately a midpoint of the boat hull, each of said at least two boat hulls comprising:

a lower hull portion; and an upper hull portion joined to said lower hull portion, said upper hull portion, excluding any appurtenances, is substantially a mirror image of said lower hull portion and said forebody and said afterbody, both without appurtenances, are similar but with one of said forebody and afterbody at least partially rotated about a longitudinal axis of the boat hull with respect to the other of the forebody and afterbody, said lower hull portion including a water plane which is asymmetric about a midpoint section transverse to the boat hull; and means for interconnecting said at least two boat hulls;

means for mounting a sail with respect to at least one of said boat hulls;

and means for steering at least one of said boat hulls.

12. A multihull sailboat in accordance with claim 11 wherein said multihull sailboat comprises a trimaran sailboat, said at least two boat hulls comprise three boat hulls, at least two of said three boat hulls are identical in size and shape, said means for interconnecting comprises means for separately interconnecting each of said at least two boat hulls to said third boat hull, said third boat hull including a keel means for reducing leeway under sail.

13. A multihull sailboat in accordance with claim 12, wherein said at least two of said three boat hulls are smaller than said third boat hull.

14. A multihull sailboat in accordance with claim 13, wherein said means for separately interconnecting comprises a pair of cross beams for each of said two smaller boat hulls, each of said cross beams having two ends, each of said smaller boat hulls including a pair of cross beam sockets located in a plane generally parallel with the longitudinal axis of said smaller boat hull and spaced apart along said longitudinal axis, said larger hull including a pair of cross beam sockets for each of said two smaller boat hulls, said larger boat hull cross beam sockets located in a plane generally horizontal and parallel with the longitudinal axis of said larger boat hull and spaced apart along said large boat hull longitudinal axis, one end of each cross beam having one end located in a smaller boat hull cross beam socket and one end located in a larger boat hull cross beam socket.

15. A multihull sailboat in accordance with claim 14, wherein said cross beams are identical.

* * * * *